US012601037B2

(12) United States Patent
Bolsonella et al.

(10) Patent No.: US 12,601,037 B2
(45) Date of Patent: Apr. 14, 2026

(54) STEEL HAVING HIGH MECHANICAL PROPERTIES AND MANUFACTURING PROCESS THEREOF

(71) Applicants: NEXTER MUNITIONS, Versailles (FR); UNIVERSITE DE BOURGOGNE, Dijon (FR)

(72) Inventors: Arnaud Bolsonella, Bourges (FR); Hervé Couque, Bourges (FR); Frédéric Bernard, Bourges (FR)

(73) Assignees: NEXTER MUNITIONS, Versailles (FR); UNIVERSITE DE BOURGOGNE, Dijon (FR)

( * ) Notice: Subject to any disclaimer, the term of this patent is extended or adjusted under 35 U.S.C. 154(b) by 620 days.

(21) Appl. No.: 18/021,692

(22) PCT Filed: Aug. 16, 2021

(86) PCT No.: PCT/IB2021/057516
§ 371 (c)(1),
(2) Date: Feb. 16, 2023

(87) PCT Pub. No.: WO2022/038484
PCT Pub. Date: Feb. 24, 2022

(65) Prior Publication Data

US 2023/0332279 A1 Oct. 19, 2023

(30) Foreign Application Priority Data

Aug. 21, 2020 (FR) ..... 2008546

(51) Int. Cl.

| | |
|---|---|
| ***C22C 38/10*** | (2006.01) |
| ***B22F 3/10*** | (2006.01) |
| ***B22F 3/105*** | (2006.01) |
| ***B22F 3/24*** | (2006.01) |
| ***B22F 9/04*** | (2006.01) |
| ***B22F 9/08*** | (2006.01) |
| ***C22C 33/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |

(52) U.S. Cl.

CPC ..... *C22C 38/105* (2013.01); *B22F 3/1028* (2013.01); *B22F 3/105* (2013.01); *B22F 3/24* (2013.01); *B22F 9/04* (2013.01); *B22F 9/082* (2013.01); *C22C 33/0207* (2013.01); *C22C 33/0285* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *B22F 2003/1051* (2013.01); *B22F 2003/248* (2013.01); *B22F 2009/043* (2013.01); *B22F 2009/0824* (2013.01); *B22F 2301/35* (2013.01); *B22F 2304/10* (2013.01); *B22F 2998/10* (2013.01); *B22F 2999/00* (2013.01)

(58) Field of Classification Search
None
See application file for complete search history.

(56) References Cited

U.S. PATENT DOCUMENTS

| | | | |
|---|---|---|---|
| 11,186,886 | B2 | 11/2021 | Perrin Guerin et al. |
| 11,499,203 | B2 | 11/2022 | Verleene |
| 2018/0311729 | A1 | 11/2018 | Allemand et al. |

FOREIGN PATENT DOCUMENTS

| | | | |
|---|---|---|---|
| CN | 111206174 | A | 5/2020 |
| DE | 20 2005 015 896 | U1 | 2/2007 |
| DE | 20 2006 006 747 | U1 | 9/2007 |
| EP | 2 010 329 | B1 | 1/2010 |
| FR | 3 042 993 | A1 | 5/2017 |
| JP | 2008-208401 | A | 9/2008 |
| JP | 2013-185249 | A | 9/2013 |
| WO | 2016/170519 | A1 | 10/2016 |
| WO | 2019/122635 | A1 | 6/2019 |

OTHER PUBLICATIONS

Riccardo Casati et al. "Aging Behaviour and Mechanical Performance of 18-Ni 300 Steel Processed by Selective Laser Melting". Metals, 2016, vol. 6, 218.

"Standard Test Methods for Determining Average Grain Size". ASTM International E112-13, Jan. 1, 2013, <URL:http://www.astm.org/cgi-bin/resolver.cgi?E112-13>.

Feb. 8, 2022 International Search Report issued in International Patent Application No. PCT/IB2021/057516.

Feb. 8, 2022 Written Opinion issued in International Patent Application No. PCT/IB2021/057516.

May 6, 2021 Search Report issued in French Patent Application No. 2008546.

May 6, 2021 Written Opinion issued in French Patent Application No. 2008546.

(Continued)

*Primary Examiner* — Anthony M Liang
(74) *Attorney, Agent, or Firm* — OLIFF PLC

(57) ABSTRACT

A steel having high mechanical properties, characterized in that it has the following composition by weight: 12% to 25% Nickel; 7.4% to 20% Cobalt; 3% to 11% Molybdenum; 0.2% to 2.21% addition elements, the remainder being iron, the structure of the material including a combination of fine grains and ultrafine grains, the so-called fine grains having a grain size of between 1.2 micrometers and 3 micrometers and the so-called ultrafine grains having a grain size of between 0.2 and 1 micrometer, the proportion of ultrafine grains being between 55% and 65%, and a process for manufacturing the steel.

11 Claims, 2 Drawing Sheets

(56) References Cited

OTHER PUBLICATIONS

F.F. Conde et al. "Effect of Thermal Cycling and Aging Stages on the Microstructure and Bending Strength of a Selective Laser Melted 300-Grade Maraging Steel". Materials Science & Engineering A, 2019, vol. 758, pp. 192-201.

STEEL HAVING HIGH MECHANICAL PROPERTIES AND MANUFACTURING PROCESS THEREOF

The subject of the invention is a steel having high mechanical properties and the manufacturing process thereof.

Known steels having high mechanical properties particularly include Maraging steels. The name Maraging is derived from the contraction between the words «martensitic» and «ageing» to indicate that they are steels having a martensitic structure and hence with high nickel content, which are subjected to ageing treatment of tempering type.

The effect of said treatments is to cause intermetallic precipitates which increase the tensile strength of the steel whilst maintaining extensive hardness.

Maraging steels can have a tensile strength close to 2500 Megapascals for example, and their hardness is in the region of 500 Hv.

Known maraging steels are most often prepared by forging or moulding. They are generally classified in accordance with the American numbering Mxxx where xxx gives the nominal ultimate tensile strength of the material in kilopound per square inch (ksi) which converts to an international unit in Megapascals (MPa) with the expression:

1 MPa=0.145 ksi or 1 ksi=6.896 MPa

Maraging steels are therefore commercially available of M200, M300, M400 type which have ultimate tensile stresses of 1379 MPa, 2069 MPa and 2758 MPa respectively.

One of the drawbacks of known steels of Maraging type is that they have relatively reduced ductility. In general, the elongation of these steels up to their ultimate tensile stress is in the region of 1.5%. This characteristic restricts the field of application thereof to parts for which safety aspects are not involved since the breaking conditions of these steels are hard to predict.

It has been sought to obtain steel compositions and manufacturing processes which allow the combining of both high mechanical strength and ductility.

From patent JP2013-185249 for example a material is known of Maraging type having a high nickel and cobalt content incorporating a dispersed nanostructure that improves the ductility thereof (nanograins of grain size between 5 nanometres and 50 nanometres).

This material is prepared by casting followed by forging and homogenizing heat treatment (1100° C. for 24 hours), followed by quenching. This heat treatment is followed by cold treatment via high-pressure torsion, itself followed by annealing.

While all these treatments allow elongation at break to be obtained possibly reaching 20% for an ultimate tensile stress of 2400 MPa, the process is lengthy and costly to implement.

It is the objective of the invention to propose a steel having high mechanical properties and the process of manufacturing the same, which allow a notable increase in ductility whilst maintaining high strength characteristics.

Therefore, the subject of the invention is a steel having high mechanical properties, characterized in that it has the following composition by weight:

12% to 25% Nickel;
7.4% to 20% Cobalt;
3% to 11% Molybdenum;
0.2% to 2.21% addition elements;
the remainder being iron.

With said composition, it is possible to obtain a steel having high mechanical properties (of Maraging type) and having an ultimate tensile stress which varies from 1300 MPa to 2800 MPa.

The structure of the material of the invention further comprises a combination of fine grains and ultrafine grains, the so-called fine grains having a grain size of between 1.2 micrometers and 3 micrometers and the so-called ultrafine grains having a grain size of between 0.2 micrometer and 1 micrometer, the proportion of ultrafine grains being between 55% and 65% (range centred around 60%).

The fine grains impart plastic strain stability to the material before ultimate tensile stress.

The ultrafine grains impart high mechanical strength to the material.

When the steel of the invention is tested for tensile strength in its non-treated state (no tempering treatment), the true plastic strain thereof up to ultimate tensile stress, corresponding to stable strain designated $\varepsilon_{pEM}$, is at least 300% higher than that of conventional maraging steels.

When the steel of the invention is treated after manufacture (tempering treatment) and is then tested for tensile strength, the true plastic strain thereof up to ultimate tensile stress, corresponding to stable strain designated $\varepsilon_{pEM}$, is again at least 300% higher than that of conventional maraging steels.

In one particular embodiment of the invention, the steel of the invention having high mechanical properties can have the following composition by weight:

12% to 25% Nickel;
7.4% to 20% Cobalt;
3% to 11% Molybdenum;
0.15% to 1.6% Titanium;
0.05% to 0.2% Aluminum;
from 0% to 0.1% Silicon and/or Manganese;
from 0% to 0.08% Nitrogen and/or Oxygen;
from 0% to 0.03% Carbon;
from 0% to 0.01% Sulfur and/or Phosphorus;
the remainder being iron.

In one particular embodiment, the steel of the invention having high mechanical properties can have the following composition by weight:

15.7% Nickel;
7.4% Cobalt;
4.8% Molybdenum;
0.6% Titanium;
0.05% to 0.2% Aluminum;
from 0% to 0.1% Silicon and/or Manganese;
from 0% to 0.08% Nitrogen and/or Oxygen;
from 0% to 0.03% Carbon;
from 0% to 0.01% Sulfur and/or Phosphorus;
the remainder being iron.

The material of the invention is preferably prepared by alloyed steel powder metallurgy i.e. via a sintering process and in particular a process known under the name Spark Plasma Sintering (SPS).

The process for manufacturing a steel of the invention having high mechanical properties is characterized in that it comprises the following steps:

- preparing a steel powder having the desired composition, for example by gas atomization, and having a grain size of between 5 and 100 micrometers;
- mechanical milling in a planetary ball mill until a powder is obtained having a grain size associating fine grains (grain size between 1.2 and 3 micrometers) and ultrafine grains (grain size between 0.2 micrometer and 1 micrometer), the proportion of ultrafine grains being between 55% and 65% (range centred around 60%);

mixing the powders obtained;

sintering the powder mixture with SPS flash sintering technology, to obtain a block of steel.

The alloyed powders having the desired composition are prepared with a conventional method for powder preparation.

For example, physical methods are known such as gas atomization or water atomization. In these methods, material in the molten state is atomized to droplet form by an inert gas (argon or nitrogen) or by water.

A method is also known whereby atomization is performed by a rotating electrode atomizing molten material to droplet form under the action of centrifugal force.

Finally, a plasma atomization method is known which atomizes the material by plasma evaporation.

Chemical methods are also known for preparing powders. According to these methods, reduction of oxides is carried out through the action of a chemical reducing agent, or else powders are caused to be electrolytically deposited on the cathode of an electrolytic cell. Finally metal carbonyls can be decomposed under the action of a gas (carbon monoxide).

And finally, there exist mechanical methods for preparing powders which use dry milling with ball, bead or planetary mills, to mill agglomerates of alloys to obtain the desired powders.

The powders having composition are the desired mechanically milled with a planetary ball mill until a powder is obtained having a grain composition associating fine grains (grain size between 1.2 micrometers and 3 micrometers) and ultrafine grains (grain size between 0.2 micrometer and 1 micrometer), with a proportion of fine grains of between 55% and 65% (range centered around 60%).

Planetary ball mills are well-known. A high energy planetary mill can be used of type P4 marketed by Fritsch comprising a support disc on which two bowls are fastened rotating in opposite directions. Said planetary mills are described for example in the utility models DE202005015896-U1 and DE202006006747-U1 and in patent EP2010329.

The powders to be milled are placed in the bowls in hardened steel containing balls that are also in hardened steel. The bowls are set in rotation at a speed @ which is of opposite sign to the rotating speed Q of the support disc carrying the bowls.

The centrifugal force due to rotations in opposite directions of the support disc and bowls, and impact forces between the powders and balls on rotating allow milling of the powders.

According to another characteristic of the process of the invention, the planetary mill may have a support disc having a diameter of approximately 800 mm, the rotation of the support disc having a speed between 50 rpm and 350 rpm, whereas rotation of the bowls is between −50 rpm and −350 rpm, the ratio between the mass of the balls arranged in each bowl and the mass of powder in said bowl being between 4 and 10.

Depending on the quantities of powder used, the volume of the bowls can be chosen to be between 30 millilitres and 1 litre.

The bowls can be two or four in number depending on the model of planetary mill used.

Milling can be conducted for a time of 2 to 4 hours.

The milling conditions obtained with planetary mills are of frictional type. They allow a powder to be obtained associating fine grains and ultra-fine grains in a proportion of approximately 60% (by mass) of ultrafine grains and 40% (by mass) of fine grains. The grain size of the fine grains being between 1.2 micrometers and 3 micrometers, and that of the ultrafine grains being between 0.2 micrometer and 1 micrometer.

Depending on length of milling times, the proportions of ultrafine grains may vary between 55% and 65% (ranged centred around 60%).

Once obtained, the powders are mixed, for example using a mixer with three-dimensional movement such as the one marketed under the trade name Turbula.

After mixing, the powders are sintered with flash sintering technology of Spark Plasma Sintering type.

This well-known technique allows limiting of grain enlargement and hence maintaining of the grain sizes of fine and ultrafine structure of the powders obtained with the milling.

The equipment permitting SPS flash sintering is described for example in patent FR3042993. According to this technique, the powder is placed in a graphite die. Graphite electrodes are positioned either side of the powder block and an axial compression force is applied to the powder block while a rapid rise in temperature is caused by passing a current between the electrodes.

Advantageously, the flash sintering cycle comprises:

a rise to austenitizing temperature (higher than 820° C.) at a heating rate of between 25° C./minute and 200° C./minute;

a temperature hold for a time of 5 to 20 minutes at austenitizing temperature;

cooling to ambient temperature at a cooling rate of between 25° C./minute and 200° C./minute.

Moreover, the axial force applied to the block throughout the entire duration of the cycle can be between 100 kilo Newtons and 1000 kilo Newtons.

These parameters ensure consolidation and rapid densification of the workpieces.

The current is of strong intensity, varying from 1000 to 30000 Amperes, with a voltage varying from 0 to Volts.

With suitable equipment, it is possible to form blocks of steel having a diameter greater than 60 mm and height greater than 10 mmm.

The desired grain structure is maintained within the formed block.

The blocks of steel thus obtained are of so-called «maraging type» on account of the composition thereof, but they have not yet undergone tempering treatment.

They are exclusively composed of martensite and have an ultimate tensile nominal stress varying from 800 to 1600 MPa.

It will be noted that these characteristics of tensile strength are obtained without the need to apply the austenitizing cycle (850° C. for 2 h followed by quenching) which is usually performed on forged or moulded parts of same strength.

In one variant of the process of the invention, it is possible, after the sintering operation, to carry out ageing heat treatment of tempering type.

This heat treatment may entail bringing the block of steel to a temperature of 480° C. for 3 hours.

This ageing heat treatment (also called structural hardening) leads to precipitation of intermetallic compounds of $Ni_3Ti$ type and/or $Ni_3Mo$ and/or $Fe_2Mo$.

In this manner, a block of Maraging steel is obtained having very high mechanical properties. Ultimate tensile nominal stresses then vary between 1500 MPa and 2900 MPa.

Two examples of materials of the invention will be described with reference to the appended Figures in which.

Figure 3:
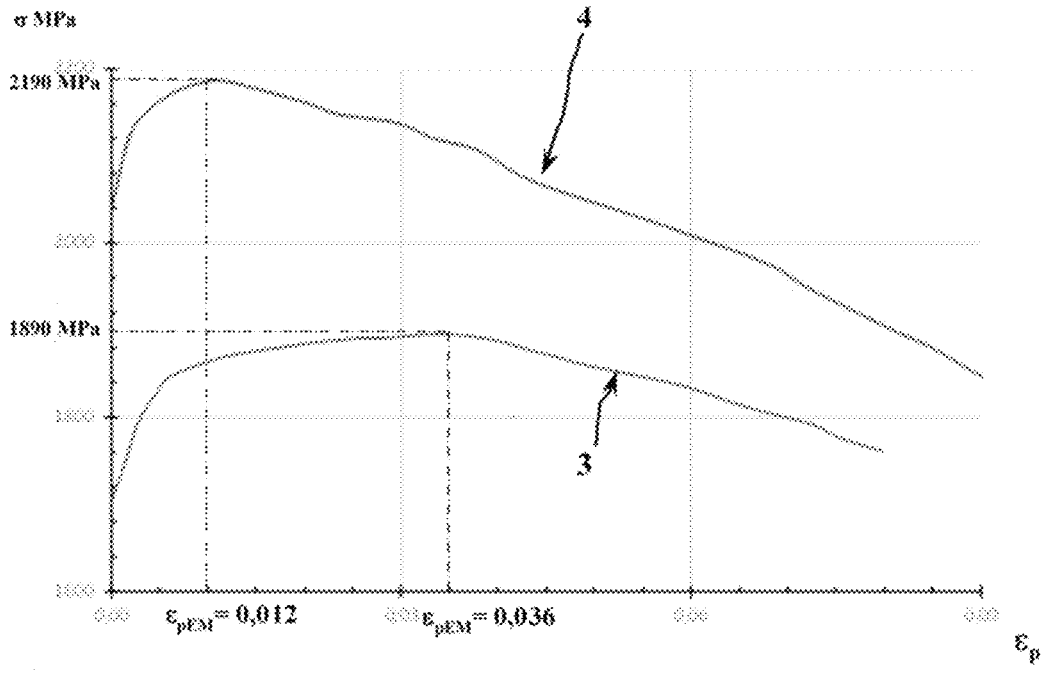
Figure 4:
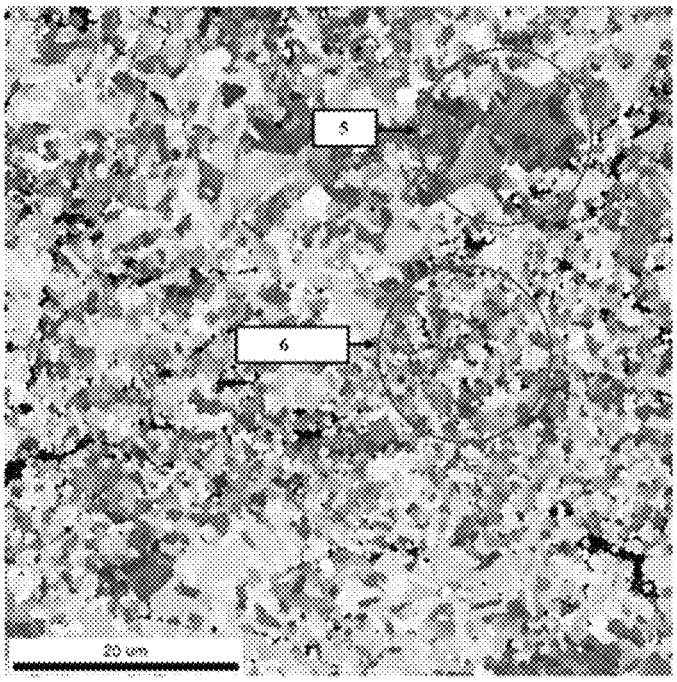

FIG. 3 gives the tensile stress-strain curve for a steel according to a second embodiment of the invention, compared with a reference material;

FIG. 4 is a micrograph showing the structure of the grains of the steel according to this second embodiment.

EXAMPLE 1

Steel having high mechanical properties of Maraging M300 type but without tempering treatment.

This first example concerns a material prepared from powders having a grain size distribution (before milling) centred around 37 μm. The chemical composition in weight percent of these powders is the following:

15.70% nickel,
7.40% cobalt,
4.80% molybdenum,
0.60% titanium,
0.05 to 0.20% aluminum
silicon content less than or equal to 0.10%,
manganese content less than or equal to 0.10%,
phosphorus content less than or equal to 0.01%,
sulfur content less than or equal to 0.01%,
carbon content less than or equal to 0.03%,
nitrogen content less than or equal to 0.08%,
oxygen content less than or equal to 0.08%,
remainder being iron.

The powders were milled with a planetary mill under conditions of frictional type, at different rotation speeds @ and Q of 250 rpm and −250 rpm, respectively, for a milling time of less than 4 hours.

The milled powders were consolidated by flash sintering of Spark Plasma Sintering (SPS) type under uniaxial pressure of at least 70 MPa (Megapascals) at a sintering temperature lower than 950° C. and with a rate of temperature rise varying from 25° C./minute to 200° C./minute.

Sintering was followed by a hold at austenitizing temperature, still under uniaxial pressure of at least 70 MPa, and for a time of between 5 and 20 minutes.

The block was gradually cooled down to ambient temperature at a cooling rate varying from 25° C./minute to 200° C./minute.

Figure 1:
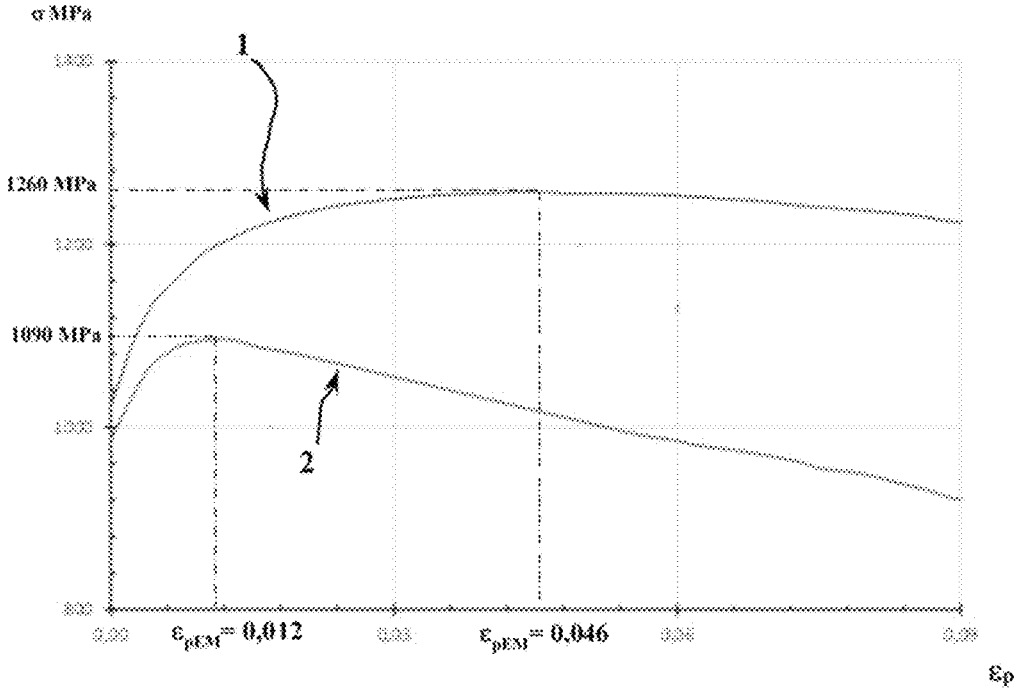
FIG. 1 shows the tensile stress-strain curve for a steel according to a first embodiment of the invention, compared with a reference material.

FIG. 1 shows tensile tests on this non-treated block of steel compared with a reference block of steel of Maraging M300 type that had not been subjected to ageing treatment i.e. a block of steel of Maraging type obtained by casting and subjected to austenitizing at 820° C. for 2 hours followed by quenching, but not subjected to tempering.

Curve 1 corresponds to the block of steel of the invention, curve 2 to the reference block of steel.

It can be seen that for the block of the invention (curve 1) the ultimate tensile nominal stress is 1260 MPa, whereas for the reference block (curve 2) this ultimate tensile nominal stress is 1090 MPa. Ultimate stress is therefore increased by 15.6%, which imparts this block with strength close to that of Maraging M200 without the need to apply tempering treatment.

Of more interest, it is observed from the curves that true plastic strain up to ultimate tensile stress ($\varepsilon_{pEM}$) for the steel of the invention (curve 1) is 380% higher than that of the reference steel (curve 2).

In the steel of this embodiment of the invention, the microstructure is of 100 martensitic type. The microstructure in the non-treated state is composed of fine and ultrafine microstructures of the starting milled powders.

More specifically, the structure is composed of about 40% fine grains of size 1.8±0.3 micrometers (μm) and about 60% ultrafine grains of size 0.6±0.2 μm.

Figure 2:
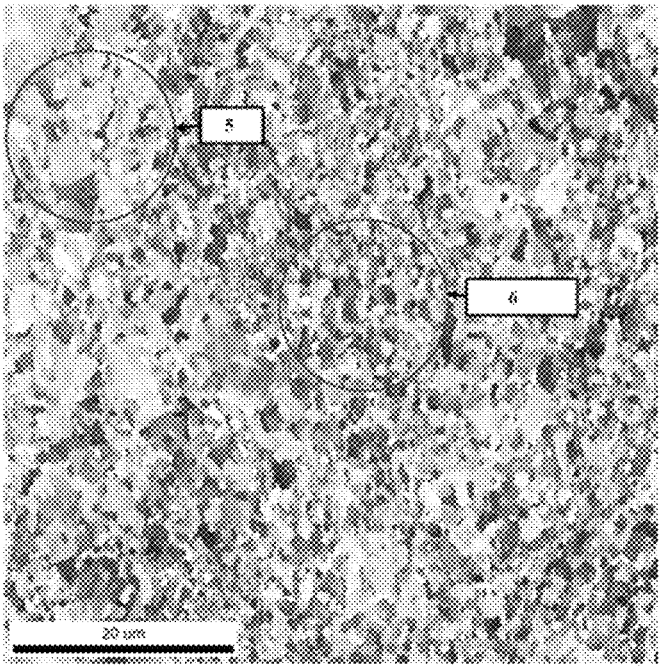
FIG. 2 is a micrograph showing the structure of the grains of the steel according to this first embodiment.

FIG. 2 is a micrograph of this structure allowing viewing of these fine structures (circle referenced 5) and ultrafine structures (circle referenced 6).

The material is formed of agglomerates of fine grains composed on average of 32±5 homogeneously distributed grains. The spacing between the agglomerates of fine grains is between 8 and 14 micrometers.

EXAMPLE 2

Steel having high mechanical properties of Maraging M300 type after receiving tempering treatment.

The second example concerns a steel that is the same as in the first example but which, after preparation, has received ageing treatment of tempering type.

This ageing heat treatment (or structural hardening) of tempering type was performed by bringing the steel to a temperature of 480° C. for 3 hours.

FIG. 3 shows tensile testing of this treated block of steel compared with a reference block of steel of Maraging M300 type which had also been subjected to ageing treatment.

Curve 3 corresponds to the block of steel of the invention, curve 4 to the reference block of steel.

It can be seen in FIG. 3 that the steel of the invention (curve 3) exhibits an ultimate tensile nominal stress of 1890 MPa, which is close to the strength of a steel of M270 type.

Of more interest, true plastic strain up to ultimate tensile stress ($\varepsilon_{pEM}$) for the steel of the invention (curve 3) is 300% higher than that of the reference steel (curve 4) which is a Maraging steel prepared with the conventional approach of casting or forging type.

In the steel of this embodiment of the invention, the microstructure is of martensitic type with avec 10% reverted austenite. The microstructure in the treated state maintains the fine and ultrafine microstructures of the starting milled powders.

More specifically, the structure is composed of about 40% fine grains of size 1.6±0.4 μm and about 60% ultrafine grains of size 0.8±0.2 μm.

FIG. 4 is a micrograph of this structure allowing viewing of these fine structures (circle referenced 5) and ultrafine structures (circle referenced 6).

The material is composed of agglomerates of fine grains on average composed of 25±2 homogeneously distributed fine grains. The spacing between the agglomerates of fine grains is between 9 and 15 micrometers.

The invention claimed is:

1. A steel wherein it has the following composition by weight: 12% to 25% nickel; 7.4% to 20% cobalt; 3% to 11% molybdenum; 0.2% to 2.21% additional elements, the remainder being iron, the structure of the steel comprising a combination of fine grains and ultrafine grains, the fine grains having a grain size of between 1.2 micrometers and 3 micrometers, and the ultrafine grains having a grain size of between 0.2 micrometer and 1 micrometer, the proportion of ultrafine grains being between 55% and 65%.

2. The steel according to claim 1, wherein it has the following composition:

12% to 25% nickel; 7.4% to 20% cobalt; 3% to 11% molybdenum; 0.15% to 1.6% titanium; 0.05% to 0.2% aluminum; 0% to 0.1% of at least one of silicon and manganese; 0% to 0.08% of at least one of nitrogen and oxygen; 0% to 0.03% carbon; 0% to 0.01% of at least one of sulfur and phosphorus, the remainder being iron.

3. The steel according to claim 2, wherein it has the following composition:

15.7% nickel; 7.4% cobalt; 4.8% molybdenum; 0.6% titanium; 0.05% to 0.2% aluminum; 0% to 0.1% of at least one of silicon and manganese; 0% to 0.08% of at least one of nitrogen and oxygen; 0% to 0.03% carbon; 0% to 0.01% of at least one of sulfur and phosphorus, the remainder being iron.

4. A process for manufacturing a steel according to claim 1, wherein the process comprises the following steps:

preparing a steel powder having the composition, and having a grain size of between 5 and 100 micrometers;

mechanical milling with a planetary ball mill until a powder is obtained having a grain size distribution associating fine grains having a grain size between 1.2 micrometers and 3 micrometers and ultrafine grains having a grain size between 0.2 micrometer and 1 micrometer, the proportion of ultrafine grains being between 55% and 65%;

mixing the powders obtained;

sintering the powder mixture using SPS flash sintering technology, to obtain a block of steel.

5. The process for manufacturing a steel according to claim 4, wherein the mechanical milling is performed on a planetary mill with a support disc carrying bowls, the support disc having a diameter of approximately 800 mm, the rotating speed of the support disc being between 50 rpm and 350 rpm, whereas the rotating speed of the bowls is equal to the rotating speed of the support disc, with the bowls rotating in an opposite direction as a rotation direction of the support disc, a ratio between a mass of balls arranged in each bowl and a mass of powder in said bowl being between 4 and 10.

6. The process for manufacturing a steel according to claim 4, wherein a flash sintering cycle comprises:

a temperature rise to austenitizing temperature at a heating rate of between 25° C./minute and 200° C./minute;

a temperature hold for a duration of 5 minutes to 20 minutes at austenitizing temperature;

cooling to ambient temperature at a cooling rate of between 25° C./minute and 200° C./minute.

7. The process for manufacturing a steel according to claim 6, wherein an axial stress applied to the block throughout the entire duration of the flash sintering cycle is between 100 kilo Newtons and 1000 kilo Newtons.

8. The process for manufacturing a steel according to claim 4, wherein, after the sintering operation, ageing heat treatment is carried out of tempering type.

9. The process for manufacturing a steel according to claim 8, wherein the heat treatment consists of bringing the block of steel to a temperature of 480° C. for 3 hours.

10. The process for manufacturing a steel according to claim 4, wherein the steel powder is prepared via gas atomisation.

11. The process for manufacturing a steel according to claim 6, wherein the austenitizing temperature is higher than 820° C.

* * * * *